US011352111B2

(12) United States Patent
McNelly et al.

(10) Patent No.: US 11,352,111 B2
(45) Date of Patent: Jun. 7, 2022

(54) MODULAR SYSTEM FOR SUBMERSIBLE VEHICLE

(71) Applicant: The Johns Hopkins University, Baltimore, MD (US)

(72) Inventors: Brendan P. McNelly, Ellicott City, MD (US); Frank C. Albert, Columbia, MD (US); Richard A. Startt, Ellicott City, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 17/012,340

(22) Filed: Sep. 4, 2020

(65) Prior Publication Data

US 2021/0078685 A1 Mar. 18, 2021

Related U.S. Application Data

(60) Provisional application No. 62/901,975, filed on Sep. 18, 2019.

(51) Int. Cl.
*B63G 8/04* (2006.01)

(52) U.S. Cl.
CPC ..... *B63G 8/04* (2013.01)

(58) Field of Classification Search
CPC .... B63G 8/04; B63G 8/001; B63G 2008/002; B63B 3/56; F42B 19/00
See application file for complete search history.

(56) References Cited

U.S. PATENT DOCUMENTS

2015/0136012 A1* 5/2015 Williams ..... B63G 8/001 114/312
2016/0349387 A1* 12/2016 Rokkan ..... G01V 1/3808

FOREIGN PATENT DOCUMENTS

KR 20080086716 A * 9/2008

* cited by examiner

*Primary Examiner* — Anthony D Wiest
(74) *Attorney, Agent, or Firm* — Sung T. Kim

(57) ABSTRACT

A modular compartment bulkhead assembly is provided that includes a first external body, a bulkhead, and a second external body. The first external body segment may include a first end portion. The first end portion may be coupled to an external seal body and the external seal body may include a first internal channel. The bulkhead may include an internal seal body. The internal seal body may be configured to be inserted into the first internal channel of the external seal body to form an internal seal between the bulkhead and the first external body segment. The second external body segment may include a second end portion. The second end portion may include a second internal channel, and the external seal body may be configured to be inserted into the second internal channel to form an external seal between the external seal body and the second external body segment.

20 Claims, 15 Drawing Sheets

MODULAR SYSTEM FOR SUBMERSIBLE VEHICLE

CROSS-REFERENCE TO RELATED APPLICATIONS

This application claims the benefit of U.S. Provisional Patent Application No. 62/901,975, filed on Sep. 18, 2019, the entire contents of which are hereby incorporated herein by reference.

TECHNICAL FIELD

Example embodiments generally relate to structural containment systems and, in particular, relate to structural systems comprising sealing technologies for modular compartments of submersible vehicles.

BACKGROUND

Submersible undersea vehicles, particularly unmanned vehicles, can reach depths where extreme pressures are applied to the external body of the vehicle. Such pressures can lead to water intrusion into the internal cavities of the vehicles. Because of the likelihood of an external body leak, many vehicles include separate, internal waterproof containers within which electronics and other sensitive components are housed. However, such separate internal containers are employed merely to address the issues with the lack of reliability in conventional solutions for external seals. Additionally, once water intrusion occurs, many conventional systems lack the ability to isolate the leak and prevent intrusion into other internal areas of the vehicle that may house sensitive components.

BRIEF SUMMARY OF SOME EXAMPLES

According to some example embodiments, a modular compartment bulkhead assembly is provided. The modular compartment bulkhead assembly may be a component of a submersible vehicle. The modular compartment bulkhead assembly may comprise a first external body segment, a bulkhead, and a second external body segment. The first external body segment may comprise a first end portion. The first end portion may be coupled to an external seal body, and the external seal body may comprise a first internal channel. The bulkhead may comprise an internal seal body. The internal seal body may be configured to be inserted into the first internal channel of the external seal body to form an internal seal between the bulkhead and the first external body segment. The second external body segment may comprise a second end portion. The second end portion may comprise a second internal channel. The external seal body may be configured to be inserted into the second internal channel to form an external seal between the external seal body and the second external body segment.

According to some example embodiments, another modular compartment bulkhead assembly is provided. The modular compartment bulkhead assembly may comprise a first external body segment, a bulkhead, and a second external body segment. The first external body segment may comprising a first end portion. The first end portion may be coupled to an external seal body, and the external seal body may comprise a first internal channel. The bulkhead may comprise a bulkhead wall disposed within the first internal channel of the external seal body. The second external body segment may comprise a second end portion. The second end portion may comprise a second internal channel, and the external seal body may be configured to be inserted into the second internal channel to form an external seal between the external seal body and the second external body segment.

According to some example embodiments, a method for assembling a modular compartment bulkhead assembly of a submersible vehicle is provided. The method may comprise inserting an internal seal body of a bulkhead into a first internal channel of an external seal body of an end portion of a first external body segment to piston seal the bulkhead to the first external body segment via a first internal seal ring disposed between the internal seal body and the first internal channel. The method may further comprise inserting the external seal body into a second internal channel in a second end portion of a second external body segment to piston seal the first external body segment to the second external body segment via a first external seal ring disposed between the external seal body and the second internal channel.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1A:
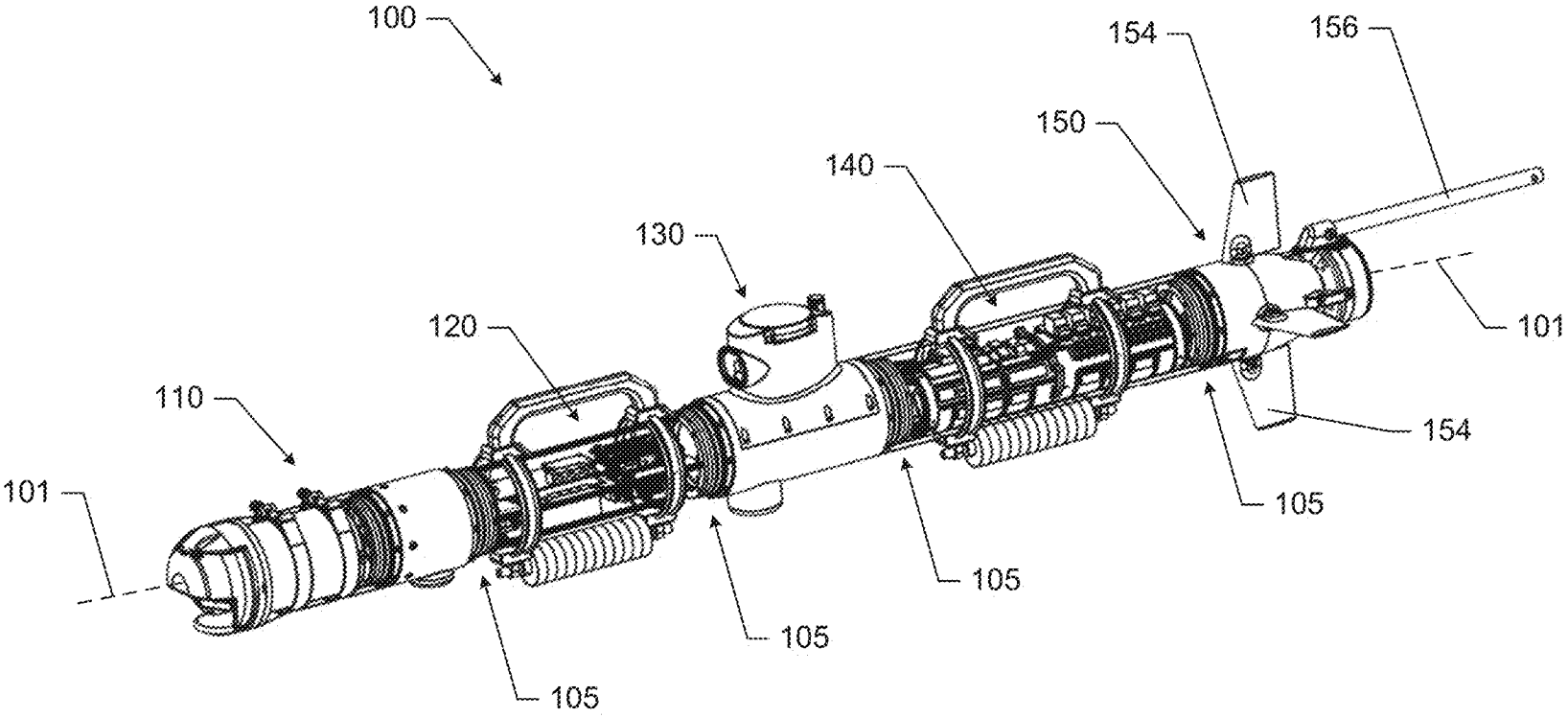
FIG. 1A illustrates an example submersible vehicle according to some example embodiments.

Some example embodiments will now be described more fully with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements Like reference numerals refer to like elements throughout. The term "or" as used herein is defined as the logical or that is true if either or both are true.

According to some example embodiments, a submersible vehicle and an approach for compartmentalizing and forming external and internal seals for modular compartments of the submersible vehicle is provided. In this regard, the submersible vehicle may be an unmanned underwater vehicle (UUV) or, in some instances, the vehicle may be a manned vehicle. According to some example embodiments, the vehicle may have a modular design that permits modular compartments to be accessed individually and readily interchanged. In this manner, the vehicle may therefore be readily adaptable to support a number of applications that can be performed by the vehicle. For example, the vehicle may be configured with modular compartments for exploration, reconnaissance, and deepwater scientific studies. However, the same vehicle may, for example, later be reconfigured with modular compartments for patrolling sensitive aquatic environments, monitoring for intruders into secure areas based on sensor data (e.g., sonar and camera sensors), and investigating the intruders and other suspicious underwater activities.

According to some example embodiments, the modules of the vehicle may include components that are formed as, for example, additively manufactured, molded, or machined components. According to some example embodiments, the components may be formed as additive polymer fabricated (e.g., 3D printed plastic) components. Tubing components, for example, may be formed to include integrated components described herein or, according to some example embodiments, the tubing may be stock commercial tubing.

Additionally, the components may be coupled to form a number of waterproof modular compartments of the vehicle. The modular compartments may, according to some example embodiments, form the external housing of the vehicle that is directly exposed to the underwater environment, and may also internally house, for example, electronics or other operating components. Such an approach, as further described below, is different from many conventional systems that rely upon separate internal waterproof compartments that are independent of the external vehicle shell. Additionally, the modular compartments may operate to prevent flooding of adjacent compartments when a leak or breach of one of the compartments occurs. In some instances, a modular compartment may purposely permit water to enter the compartment, but water-tight seals may prevent water from entering adjacent compartments. For example, a modular compartment may be configured to permit water to enter the compartment to take water temperature or salinity readings by sensors disposed within a modular compartment. Again, because of the modular approach, compartments adjacent to this flooded compartment may be unaffected due to the waterproof seals between the compartments. Modular compartments not only operate to prevent sensitive equipment from being affected by water in an adjacent compartment, but the modular compartments also assist with maintaining buoyancy of the vehicle. For example, a leak or breach into one or two of the compartments may still not result in sinking the vehicle because other compartments may remain waterproof and may contain sufficient air (or gas) to maintain the buoyancy of the vehicle. According to some example embodiments, in the event of a need to quickly surface the vehicle, for example, due to a collision causing a breach in the external housing, a drop weight may be released by the vehicle to change its buoyancy and quickly cause the vehicle to rise to the surface, despite having an external housing breach.

According to some example embodiments, to create such waterproof modular compartments, one or more modular compartment bulkhead assemblies may be utilized. According to some example embodiments, the modular compartment bulkhead assemblies may operate to seal each modular compartment both internally (i.e., between modules) and externally from the underwater environment. The modules, employing the modular compartment bulkhead assemblies, may allow for modification to the vehicle to increase or decrease the number of modular compartments by creating the major breaks between each modular compartment of the vehicle, while also providing easy access to the internal components when necessary. Such structural flexibility allows for convenient maintenance or replacement of internal components.

The modular compartment bulkhead assemblies may be configured to form an external seal between external body segments associated with respective modular compartments, and an internal seal between modular compartments of the vehicle. In this regard, the modular compartment bulkhead assemblies may comprise the end portions of external body segments that are configured to be sealed to each other via, for example, an external seal body that extends from one of the external body segments and into an internal channel of the other external body segment to form a piston seal between the external body segments. The seal between the external body segments may be formed via one or more (e.g., two) seal rings that are disposed in respective grooves of the external seal body. In this configuration, the external body segments may be secured together, via, for example, a plurality of fasteners. As such, this engagement between the external body segments, as further described below, may form an external seal that operates to prevent intrusion of water into the associated modular compartments from the external underwater environment.

Additionally, the external seal body extending from one external body segment and inserted into an internal channel of another external body segment may comprise another internal channel. An internal seal body of a bulkhead may be inserted into the internal channel of the external seal body to form an internal seal between modular compartments. In other words, the interface between the internal channel of the external seal body and the internal seal body of the bulkhead may form an inter-compartment, internal seal between the modular compartments. To form this internal seal, the internal seal body may include, for example, two seal rings in respective grooves to cause the internal seal body to piston seal with the internal channel of the external seal body. The internal seal formed in this manner may, according to some example embodiments, prevent the intrusion of water between modular compartments in the event of an external seal failure or an external housing breach. According to some example embodiments, the bulkhead may include one or more openings configured to permit, for example, cabling to run between the modular compartments. In this regard, in order to maintain waterproof separation of the modular compartments, a filler substance, such as an epoxy, may be used to seal the openings around the cabling in the bulkhead.

In view of the foregoing, FIG. 1A illustrates an example submersible vehicle 100 according to some example embodiments. The submersible vehicle 100 may be an unmanned underwater vehicle (UUV) according to some example embodiments. The submersible vehicle 100 may comprise a plurality of modular compartments coupled to each other via respective modular compartment bulkhead assemblies 105.

In this regard, according to some example embodiments, the submersible vehicle 100 may have a generally cylindrical or tubular shape. As such, a central longitudinal axis 101 may be defined that extends through each of the modular compartments and the modular compartment bulkhead assemblies. The submersible vehicle 100 may include various systems depending on the application for the submersible vehicle 100. According to some example embodiments, the submersible vehicle 100 may include sensor systems, navigation and propulsion systems, communications systems, processing systems, power systems, or the like.

The example submersible vehicle 100 may comprise five modular compartments, although any number of modular compartments may be included depending on the application for the submersible vehicle 100. The submersible vehicle 100 may include a first modular compartment 110 that may house perception sensors including, for example, a forward looking sonar (FLS) sensor. A modular compartment bulkhead assembly 105 may be disposed between the first modular compartment 110 and the second modular compartment 120. The second modular compartment 120 may, for example, house electronics and control circuitry for autonomy, routing, communications, and other data processing. Again, the second modular compartment 120 may be separated from the third modular compartment 130 by a modular compartment bulkhead assembly 105. The third modular compartment 130 may, for example, house a camera system in a mast of the third modular compartment 130. Additionally, the third modular compartment 130 may also comprise, possibly within the mast, navigation systems and communications systems (e.g., radio frequency communications systems, acoustic communications systems, or the like). The third modular compartment 130 may also be separated from a fourth modular compartment 140 by a modular compartment bulkhead assembly 105. The fourth modular compartment 140 may house a power supply (e.g., rechargeable batteries) for providing electric power to the various systems of the submersible vehicle 100. The fourth modular compartment 140 may be separated from the fifth modular compartment 150 by a modular compartment bulkhead assembly 105. The fifth modular compartment 150 may comprise a propulsion and steering system for controlling the movement of the submersible vehicle 100. In this regard, the propulsion and steering system may comprise control surfaces in the form of movable fins 154 and a propeller (not shown). According to some example embodiments, a tether support 156 may also extend from the fifth modular compartment 150 that may be used with a tether cable to assist with recovery of the vehicle 100 in the event of a propulsion system failure during testing. According to some example embodiments, the tether cable may also support power transfer to and communications with the vehicle 100 via a remote device (e.g., a surface or land-based device).

Figure 1B:
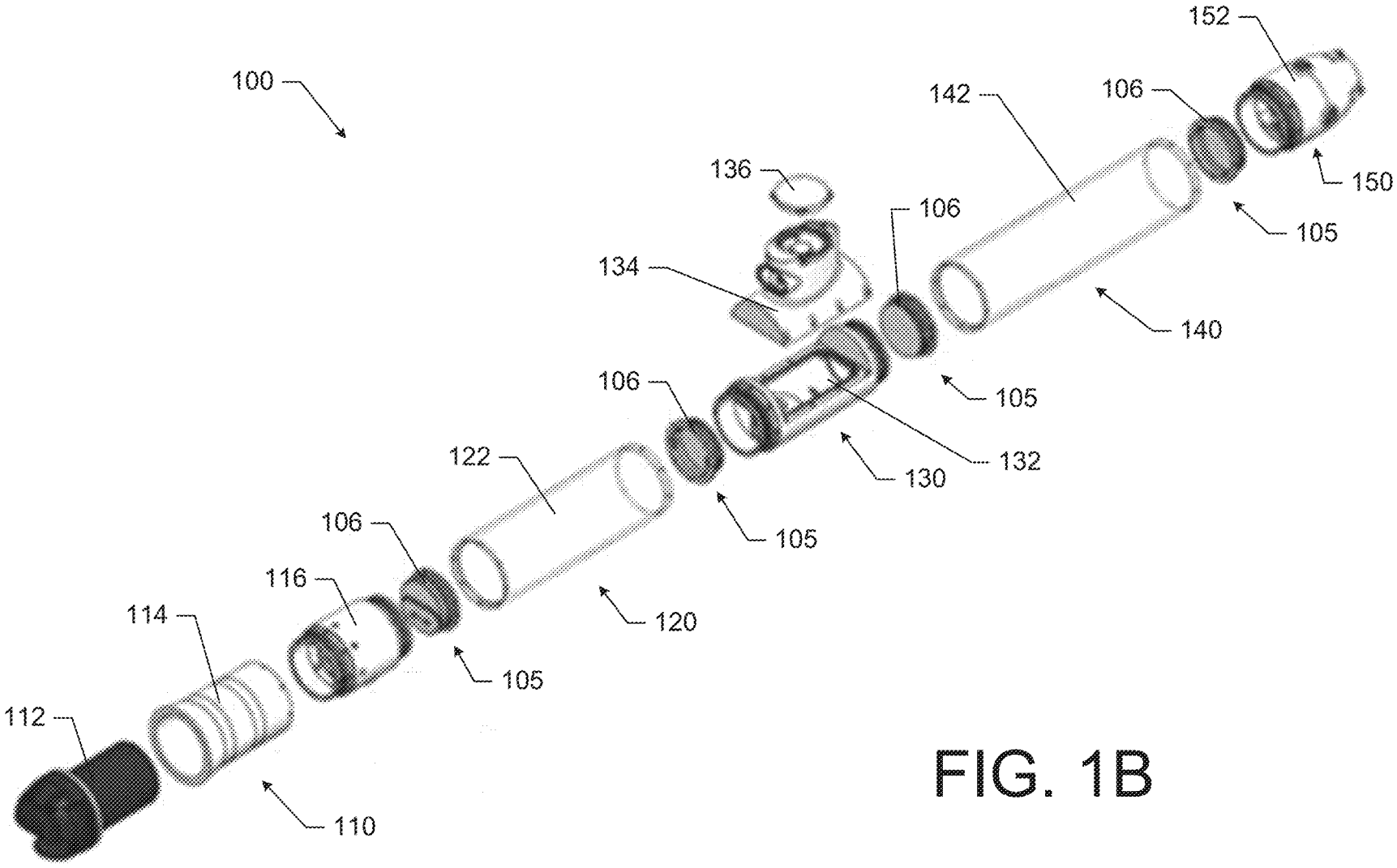
FIG. 1B illustrates some components of the submersible vehicle of FIG. 1A in an exploded view according to some example embodiments.

Referring now to FIG. 1B, an exploded view of some components of the submersible vehicle 100 is shown. In this regard, each of the external body segments of the submersible vehicle 100 are more clearly shown. An external body segment may be a component of a modular compartment that includes an external surface that is directly exposed to the external underwater environment. According to some example embodiments, the external body segments may be tubular in shape and comprise an internal channel or hollow that may support interconnection of the external body segments in association with a modular compartment bulkhead assembly and may house operating components of the submersible vehicle 100. In this regard, each modular compartment may be associated with one or more external body segment. As further described below, according to some example embodiments, an end portion of each external body segment may include affixed or integrated features or components of a modular compartment bulkhead assembly as further described below.

The first modular compartment 110 may comprise, for example, one or more sensors such as a sonar sensor 112 (e.g., an FLS sensor), environmental sensors (e.g., temperature sensors, pressure sensors, salinity sensors, chemical sensors, light sensors, or the like), or other sensors. The first modular compartment 110 may also comprise an external body segment 114, and an external body segment 116. In order to support the operation of some or all of the sensors of the first modular compartment 110, the first modular compartment 110 may be floodable to allow water to enter the compartment and permit the sensors to take measurements. The external body segment 114 and the external body segment 116 may be specifically configured to house the sonar sensor 112, which may be disposed at a forward end of the submersible vehicle 100. The first modular compartment 110 may be coupled to the second modular compartment 120 via a modular compartment bulkhead assembly 105 comprising a bulkhead 106. The second modular compartment 120 may comprise external body segment 122, which may, according to some example embodiments, be a transparent tube. The second modular compartment 120 may be coupled to the third modular compartment 130 via a modular compartment bulkhead assembly 105 comprising a bulkhead 106.

The third modular compartment 130 may comprise a external body segment 132, a mast 134, and an mast cap 136. The external body segment 132 and the mast 134 may be configured to house a camera system to provide optical image capture by the submersible vehicle 100. Additionally, according to some example embodiments, the mast 134 may house communications systems to support radio frequency and acoustic communications. Further, the mast 134 may also house, for example, a global positioning system (GPS) device configured to determine a location of the vehicle 100. The third modular compartment 130 may be coupled to the fourth modular compartment 140 via a modular compartment bulkhead assembly 105 comprising a bulkhead 106. The fourth modular compartment 140 may comprise external body segment 142, which may, according to some example embodiments, also be a transparent tube. The fourth modular compartment 140 may be coupled to the fifth modular compartment 150 via a modular compartment bulkhead assembly 105 comprising a bulkhead 106. The fifth modular compartment 150 may comprise a external body segment 152 that may be disposed at a rear end of the submersible vehicle 100 and may be configured to house a propulsion and steering system for the submersible vehicle 100.

Figure 2:
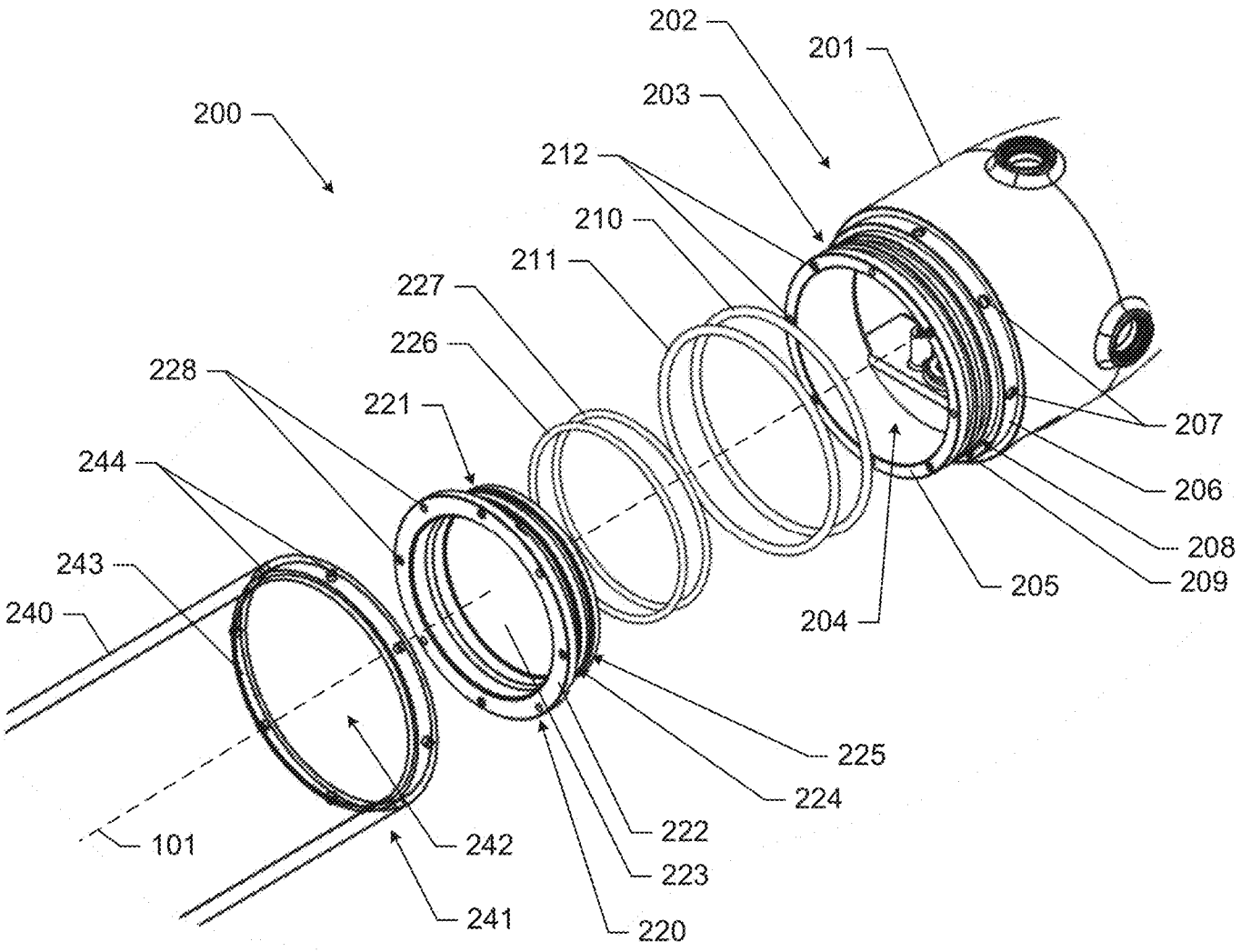
FIG. 2 illustrates an exploded view of an example modular compartment bulkhead assembly according to some example embodiments.

Having described an example submersible vehicle with modular compartments, FIG. 2 illustrates a more detailed view of an example modular compartment bulkhead assembly 200, in an exploded view, in association with the longitudinal axis 101 of the submersible vehicle 100. The description of FIG. 2 introduces various example elements of the example modular compartment bulkhead assembly 200, which is followed by a description of FIGS. 3A to 3F showing interactions between the various example elements and an example assembly process. The modular compartment bulkhead assembly 200 may be an example of the modular compartment bulkhead assembly 105 shown in FIGS. 1A and 1B. The modular compartment bulkhead assembly 200 may comprise a first end portion 202 of a first external body segment 201, a bulkhead 220, and a second end portion 241 of a second external body segment 240.

The first end portion 202 of the first external body segment 201 may comprise a number of features that are affixed to, or integrated with, the first external body segment 201. In this regard, the first end portion 202 of the first external body segment 201 may comprise an external seal body 203 and a first seating surface 206. The first seating surface 206 may be an annular surface that extends axially relative to the longitudinal axis 101. The first seating surface 206 may be recessed relative to an external wall of the first external body segment 201. The first seating surface 206 may include a plurality of holes 207 disposed around a circumference of the first seating surface 206 that may, for example, be threaded for receiving respective fasteners (e.g., screws). Each of the plurality of holes 207 may have a depth that extends radially relative to the longitudinal axis 101.

The external seal body 203 may be cylindrically shaped and extend from the first seating surface 206 in an axial direction relative to the longitudinal axis 101. Additionally, an outer surface of the external seal body 203 may be recessed relative to the first seating surface 206. The outer surface of the external seal body 203 may include a first external seal groove 208 and a second external seal groove 209. The first external seal groove 208 may be configured to receive a first external seal ring 210, and the second external seal groove 209 may be configured to receive a second external seal ring 211. The first external seal ring 210 and the second external seal ring 211 may be formed of an elastic material (e.g., rubber) such that the first external seal ring 210 and the second external seal ring 211 may be compressible to form a seal when compressed between the respective grooves 208 and 209 and another surface.

The external seal body 203 may also comprise a internal channel 204. The internal channel 204 may be cylindrical in shape and have a depth. In this regard, the internal channel 204 may form an opening into an internal space within the first external body segment 201 for housing operating components of a submersible vehicle, such as, a propulsion and steering system. The external seal body 203 may have a thickness and therefore the external seal body 203 may comprise an edge or rim that forms a bulkhead seating surface 205 at an end of the external seal body 203. The bulkhead seating surface 205 may therefore extend radially relative to the longitudinal axis 101. Further, the bulkhead seating surface 205 may comprise a plurality of holes 228 configured to receive respective fasteners where the holes 228 have a depth that extends in a axial direction relative to the longitudinal axis 101.

The modular compartment bulkhead assembly 200 may also comprise a bulkhead 220, which may be the same or similar to the bulkhead 106 mentioned above. The bulkhead 220 may comprise an internal seal body 221 and a flange 222 that are affixed to each other or integrated together. The internal seal body 221 may be cylindrical in shape and may extend axially relative to the longitudinal axis 101 from the flange 222. The internal seal body 221 may be recessed relative to the flange 222 such that the flange 222 extends radially away from the internal seal body 221 at one end of the internal seal body 221 relative to the longitudinal axis 101. The flange 222 may comprise a plurality of holes 228 that are formed around an annular surface of the flange 222 and the holes may have a depth that extends in an axial direction relative to the longitudinal axis 101.

The internal seal body 221 may comprise a bulkhead wall 223 which, according to some example embodiments, may form a base of a cavity in the internal seal body 221. The bulkhead wall 223 may be formed anywhere along a length of the internal seal body 221, such as, for example, on an end of the internal seal body 221 opposite the flange 222. According to some example embodiments, the bulkhead wall 223 may be formed, for example, such that the bulkhead wall 223 has an offset shape. The bulkhead wall 223 may have a flat, planar surface. As further described below, the bulkhead wall 223 may be a continuous surface (i.e., without holes) or the bulkhead wall 223 may include holes for permitting cabling or other components to pass through the bulkhead wall 223 that may be later sealed to maintain the waterproof barrier between the modular compartments.

The outer surface of the internal seal body 221 may include a first internal seal groove 224 and a second internal seal groove 225. The first internal seal groove 224 may be configured to receive a first internal seal ring 226, and the second internal seal groove 225 may be configured to receive a second internal seal ring 227. The first internal seal ring 226 and the second internal seal ring 227 may be formed of an elastic material (e.g., rubber) such that the first internal seal ring 226 and the second internal seal ring 227 may be compressible to form a seal when compressed between the respective grooves 224 and 225 and another surface.

The modular compartment bulkhead assembly 200 may also comprise a second end portion 241 of a second external body segment 240. In this regard, the second external body segment 240 may be a tube-shaped component that may comprise an internal channel 242. The internal channel 242 of the second external body segment 240 may extend between the ends of the second external body segment 240 and may be configured to house operational components of a submersible vehicle.

The second end portion 241 of the second external body segment 240 may comprise a second seating surface 243. The second seating surface 243 may be disposed within the internal channel 242 on an inner wall of the internal channel 242. According to some example embodiments, the second seating surface 243 may be recessed relative to the inner wall of the internal channel such that the inner diameter of the second seating surface 243 is greater than an inner diameter of the inner wall of the second external body segment 240. Additionally, the second seating surface 243 may extend axially relative to the longitudinal axis 101. Further, the second seating surface 243 may comprise a plurality of holes 244 disposed around the annular surface of the second seating surface 243. The holes 244 may have a depth that extends in a radial direction relative to the longitudinal axis 101 and may be configured to receive respective fasteners.

Having described the various elements of the modular compartment bulkhead assembly 200, FIGS. 3A to 3F will now be described which illustrate the interactions between elements of the modular compartment bulkhead assembly 200 and an example process for assembling the elements of the modular compartment bulkhead assembly 200. The FIGS. 3A to 3C illustrate step-based configurations of an assembly process for the modular compartment bulkhead assembly of FIG. 2, including perspective views of the first end portion 202 of the first external body segment 201, the bulkhead 220, and the second end portion 241 of the second external body segment 240 oriented along the longitudinal axis 101 transitioning from a dissembled state to an assembled state.

Figure 3A:
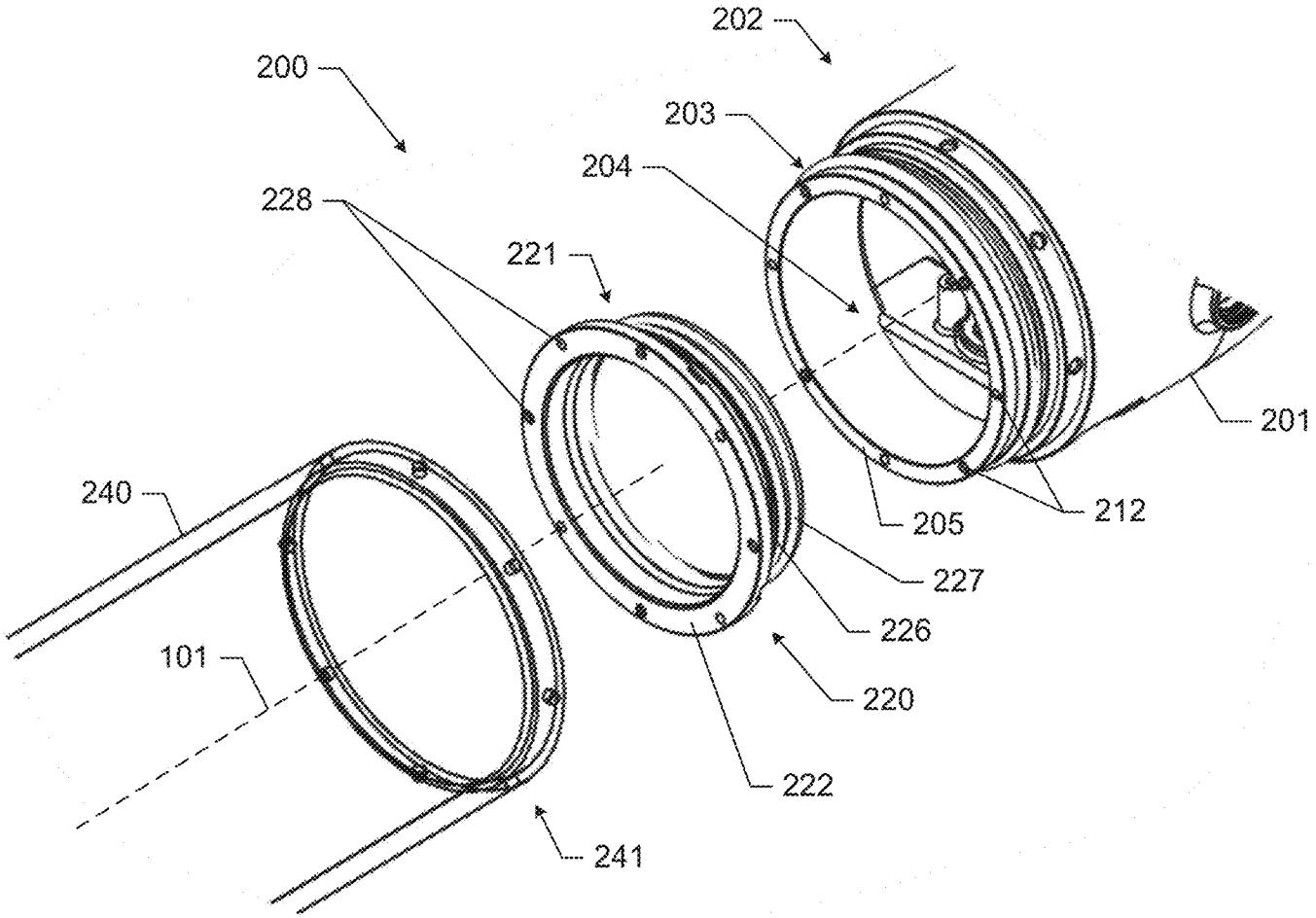
FIGS. 3A to 3C illustrate step-based configurations of an assembly process for the modular compartment bulkhead assembly of FIG. 2 according to some example embodiments.

FIG. 3A illustrates the modular compartment bulkhead assembly 200 in a disassembled state that would permit an individual access the internal modular compartments of a submersible vehicle 100. In this regard, the internal seal body 221 of the bulkhead 220 is not yet engaged with the internal channel 204 of the external seal body 203 of the first end portion 202 of the first external body segment 201. Additionally, the second end portion 241 of the second external body segment 240 is not yet engaged with the external seal body 203 of the first end portion 202 of the first external body segment 201.

Figure 3B:
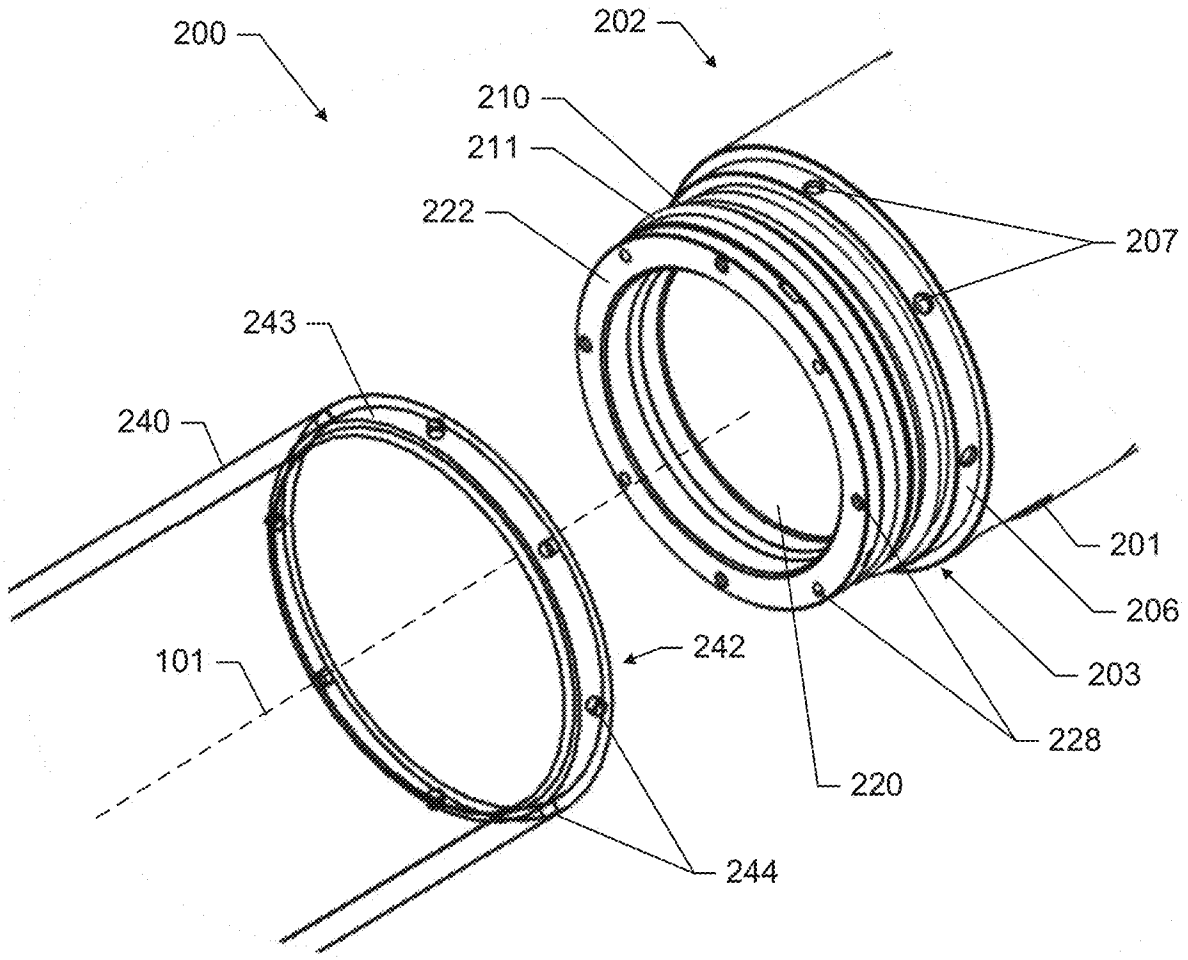
Figure 3C:
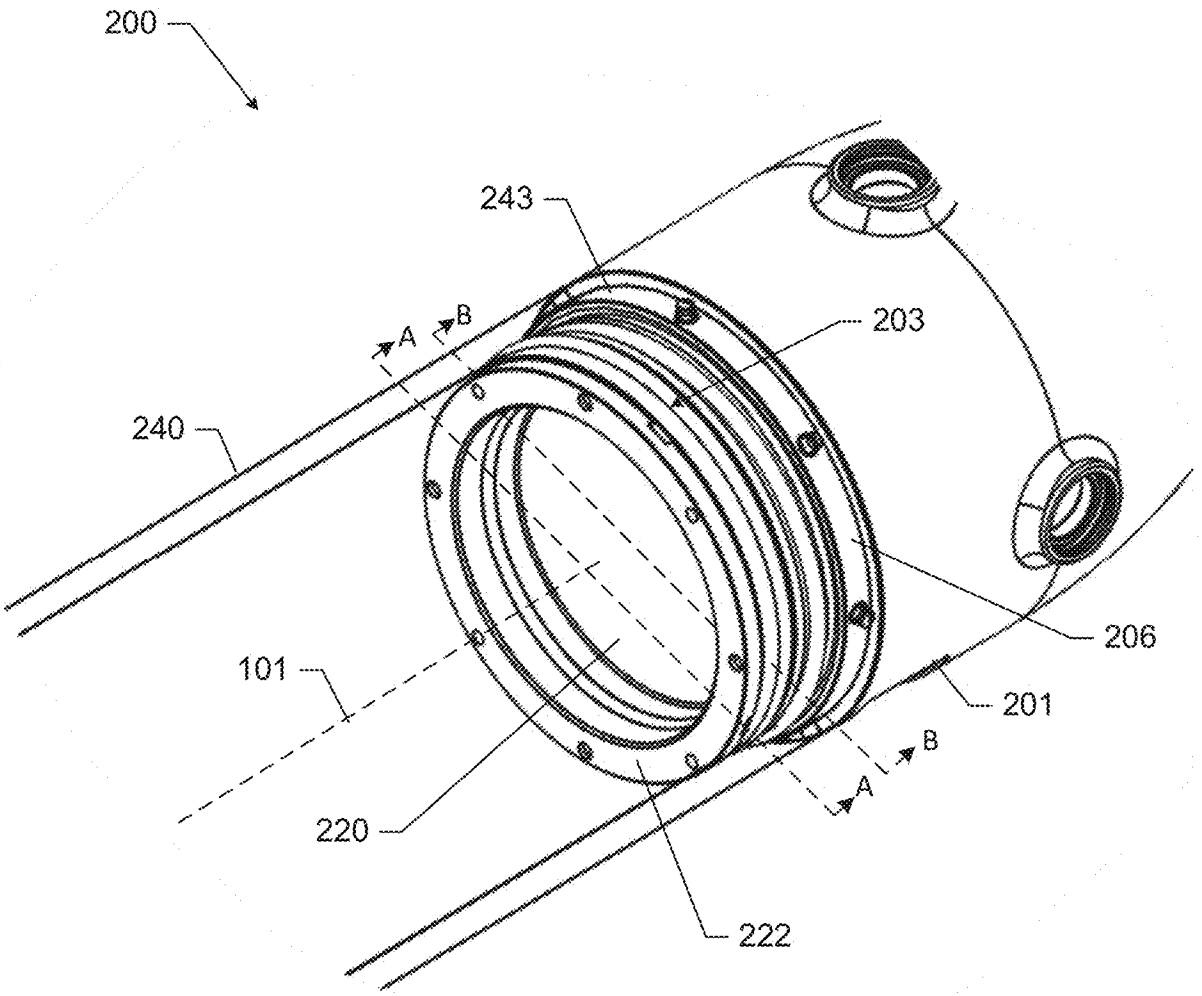

As shown in FIG. 3B, the bulkhead 220 has been coupled to the external seal body 203 of the first end portion 202 of the first external body segment 201. In this regard, the internal seal body 221, which extends from the flange 222, has been inserted into the internal channel 204. According to some example embodiments, the outer diameter of the internal seal body 221 may be slightly less than that the inner diameter of the internal channel 204 to permit the internal seal body 221 to be inserted into the internal channel 204. However, the first internal seal ring 226 and the second internal seal ring 227 may extend radially relative to longitudinal axis 101 beyond the outer diameter of the internal seal body 221. As such, when the internal seal body 221 is inserted into the internal channel 204, the first internal seal ring 226 and the second internal seal ring 227 may engage with the inner wall of the internal channel 204 and be compressed between the respective internal seal grooves 224 and 225 and the inner wall of the internal channel 204. The compression force on the first internal seal ring 226 and the second internal seal ring 227 may form an internal seal in the form of a piston seal between the modular compartment associated with the first external body segment 201 and the modular compartment associated with the second external body segment 240. Further, according to some example embodiments, the two seal rings 226 and 227 may be included to form a dual-internal seal to create redundancy and ensure a waterproof seal between modular compartments.

Engagement between the flange 222 and the bulkhead seating surface 205 may secure the bulkhead 220 to the external seal body 203. In this regard, the internal seal body 221 of the bulkhead 220 is inserted into the internal channel 204 until the flange 222 abuts the bulkhead seating surface 205 and is stopped. To secure the bulkhead 220 to the external seal body 203, the bulkhead 220 may be inserted into the internal channel 204 such that the holes 228 in the flange 222 align with respective holes 212 in the bulkhead seating surface 205. According to some example embodiments, at least the holes 212 may be threaded. Fasteners, extending in an axial direction, may be inserted into and through the holes 228 and into the holes 212 to secure the flange 222 to the bulkhead seating surface 205 and thus the bulkhead 220 to the external seal body 203. According to some example embodiments, some of the holes 228 may be used for a purpose other than to secure the flange 222 to the bulkhead seating surface 205. For example, some of the holes 228 (e.g., non-adjacent holes) may be used to secure equipment to the holes 228 within a modular compartment.

Subsequent to coupling the bulkhead 220 to the external seal body 203, the external seal body 203 may be inserted into the internal channel 242 of the second external body segment 240 to form an external seal, as shown in FIG. 3C. In this regard, the external seal body 203, with the bulkhead 220 installed, may be inserted into the internal channel 242. According to some example embodiments, the outer diameter of the flange 222 may be the same or less than the outer diameter of the external seal body 203. Further, the outer diameter of the external seal body 203 may be slightly less than the diameter of the inner wall of the internal channel 242 to permit the external seal body 203, and the flange 222, to be inserted into the internal channel 242 of the second external body segment 240. As such, the external seal body 203, with the bulkhead 220 coupled thereto, may be inserted into the internal channel 242. However, the first external seal ring 210 and the second external seal ring 211 may extend radially relative to longitudinal axis 101 beyond the outer diameter of the external seal body 203. As such, when the external seal body 203 is inserted into the internal channel 242, the first external seal ring 210 and the second external seal ring 211 may engage with the inner wall of the internal channel 242 and be compressed between the respective external seal grooves 208 and 209 and the inner wall of the internal channel 242. The compression force on the first external seal ring 210 and the second external seal ring 211 may form an external seal in the form of a piston seal between the external underwater environment and the internal channel 242 of the second external body segment 240. Further, according to some example embodiments, the two seal rings 210 and 211 may be included to form a dual-external seal to create redundancy and ensure a waterproof seal.

Engagement between the first seating surface 206 and the second seating surface 243 may secure the first external body segment 201 to the second external body segment 240. In this regard, the external seal body 203 is inserted into the internal channel 242 until a rim of second external body segment 240 engages with a rim of the first external body segment 201 after passing over the first seating surface 206 and further insertion is stopped. In this regard, according to some example embodiments, the external seal body 203 may be inserted into the internal channel 242 until a radially extending edge of the first seating surface 206 abuts a radially recessed edge of the second seating surface 243 and further insertion is stopped. To secure the first external body segment 201 to the second external body segment 240, the external seal body 203 may be inserted into the internal channel 242 such that the holes 207 in the first seating surface 206 align with respective holes 244 in second seating surface 243. According to some example embodiments, at least the holes 207 may be threaded. Fasteners, extending in a radial direction, may be inserted into and through the holes 244 and into the holes 207 to secure the first seating surface 206 and the first external body segment 201 to the second seating surface 243 and the second external body segment 240. Additionally, according to some example embodiments, the outer diameter of the external surface of the first external body segment 201 may be the same as the outer diameter of the external surface of the second external body segment 240.

Figure 3D:
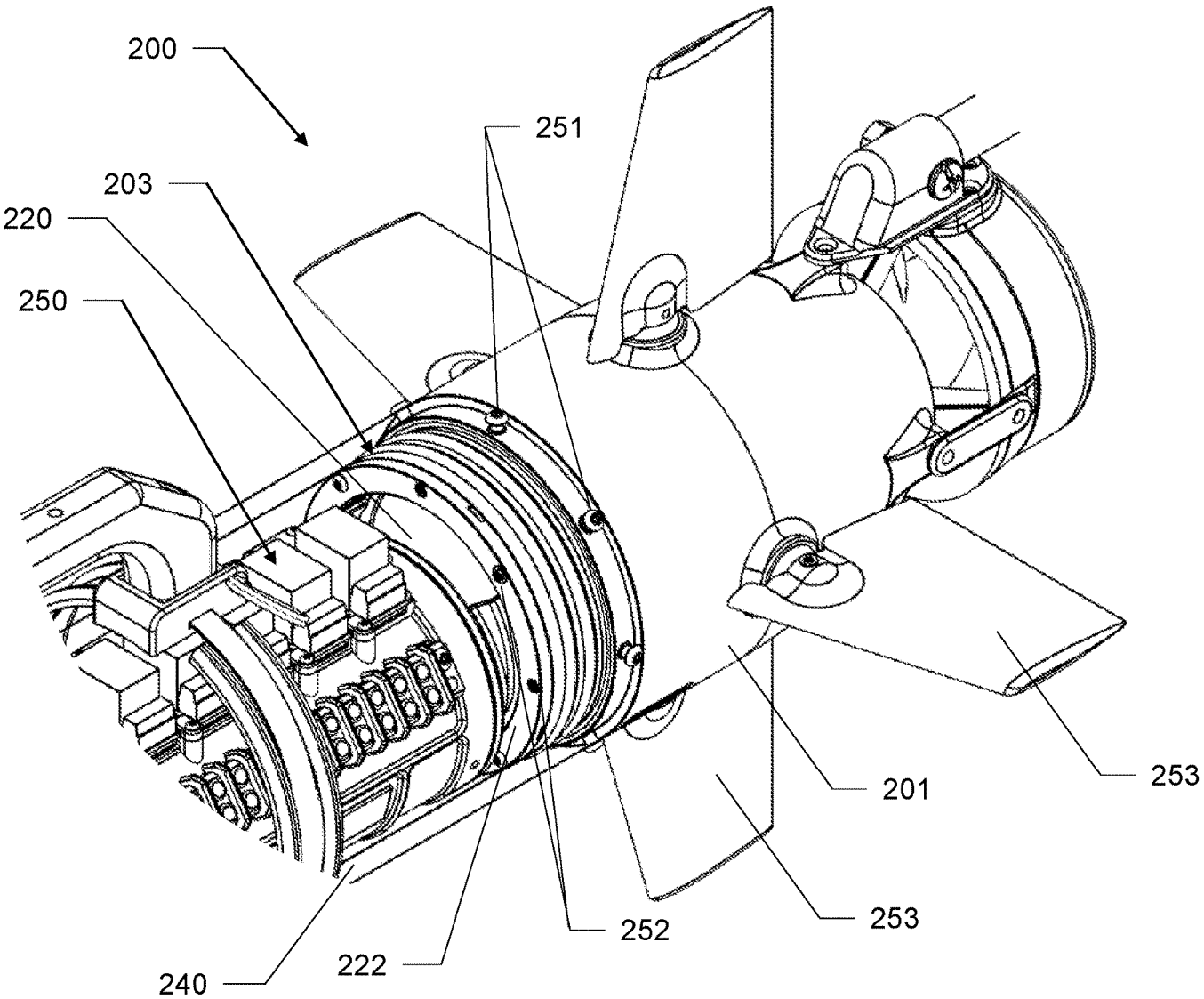
FIG. 3D illustrates an assembled modular compartment bulkhead assembly in association with operating components according to some example embodiments.

Now referring to FIG. 3D, the modular compartment bulkhead assembly 200 is shown in association with operating components of a submersible vehicle. In this regard, a power system 250 is shown installed into a modular compartment associated with the second external body segment 240. Additionally, the first external body segment 201 may be a component of the a modular compartment that houses a propulsion and steering system configured to control the operation of the fins 253 extending from the first external body segment 201. Additionally, in FIG. 3D, the axially extending fasteners 252 can be seen installed to secure the flange 222 to the bulkhead seating surface 205 of the external seal body 203. Further, the radially extending fasteners 251 can be seen installed to secure the first seating surface 206 to the second seating surface 243.

Figure 3E:
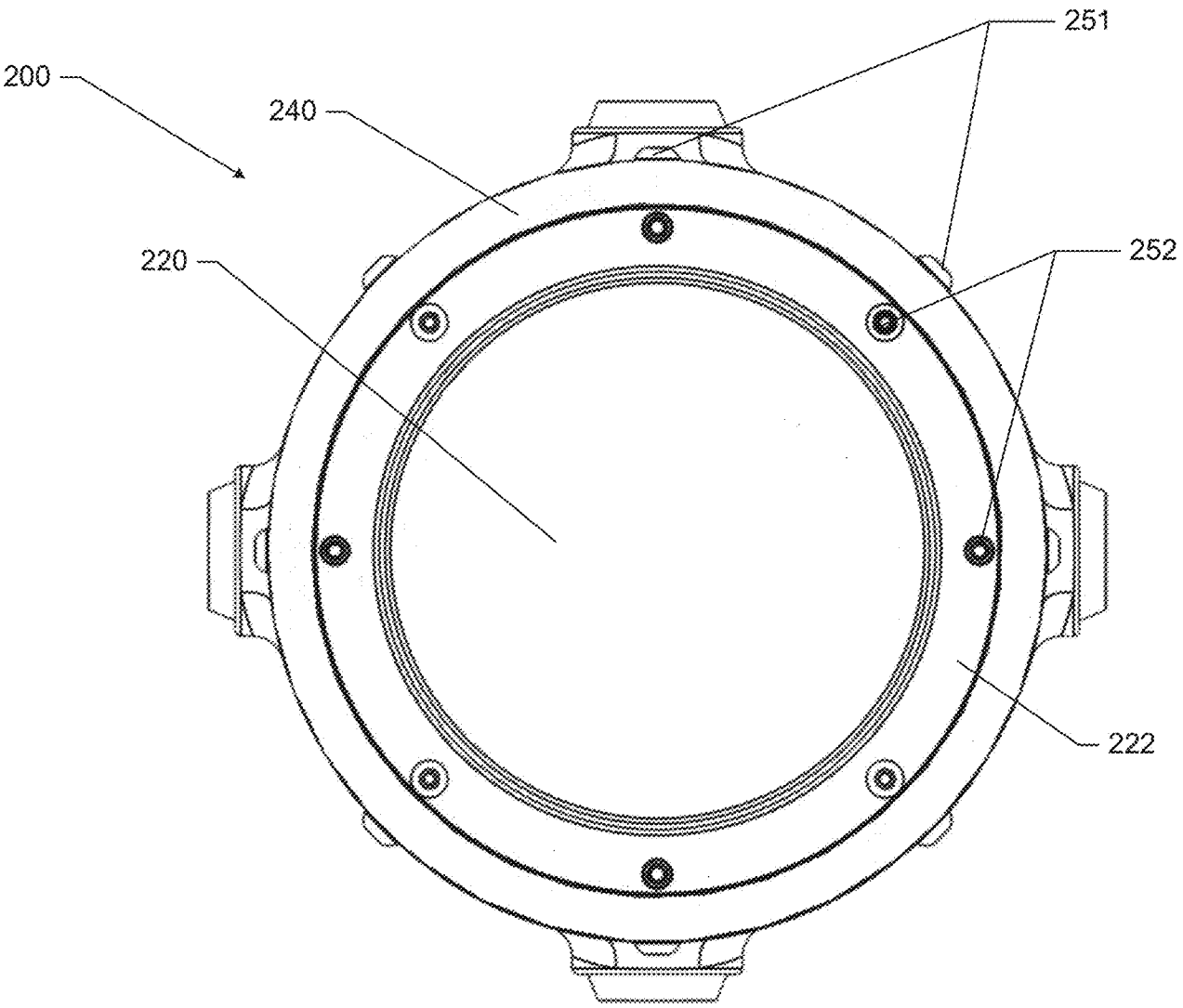
FIG. 3E illustrates a first cross-section view taken at a plane A-A of FIG. 3C of an assembled modular compartment bulkhead assembly according to some example embodiments.

FIG. 3E shows a cross-section view of the assembled modular compartment bulkhead assembly 200 shown in FIG. 3C taken at a plane A-A. As shown in FIG. 3E the outer diameter of the flange 222 of the bulkhead 220 is slightly less than the inner diameter of the first external body segment 201 to permit the flange 222 and the external seal body 203 to be inserted into the internal channel 242 of the second external body segment 240 and also form the external seal described above. Fasteners 251 and 252 can also be seen in FIG. 3E.

Fasteners 251 and 252 are shown as pan head screws. However, according to some example embodiments, the fasteners 251 and 252 may be any type of screw or other fastener that passes into both components to secure the components together. For example, according to some example embodiments, the fasteners 251 and 252 may be set screws that have no head. In example embodiments where fasteners 251 and 252 are set screws, the set screws may operate to maintain alignment of the components that the set screw are securing (e.g., prevent shifting), but may not provide a compress force when tightened due to the absence of a head.

Figure 3F:
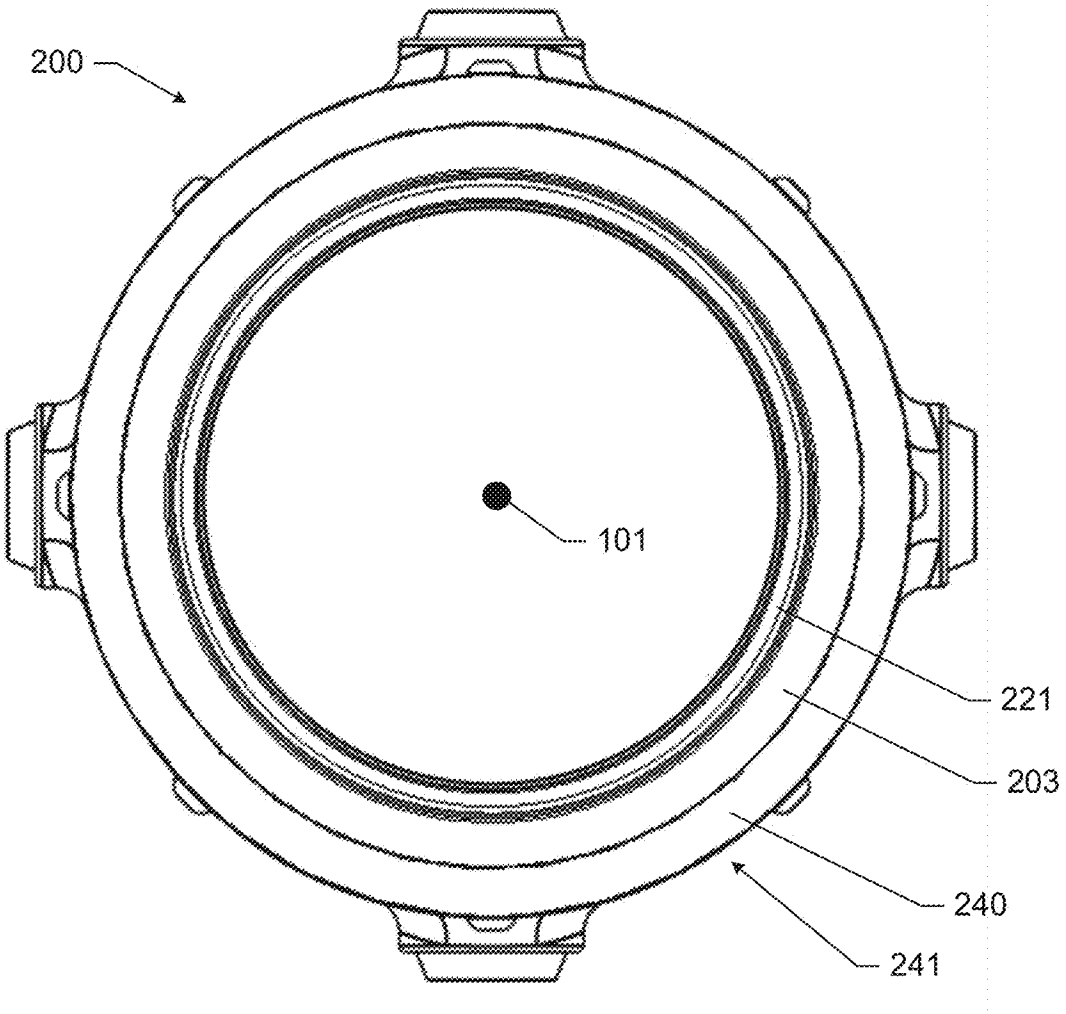
FIG. 3F illustrates a second cross-section view taken at a plane B-B of FIG. 3C of an assembled modular compartment bulkhead assembly according to some example embodiments.

FIG. 3F shows a cross-section view of the assembled modular compartment bulkhead assembly 200 shown in FIG. 3C taken at a plane B-B. In this regard, the plane B-B cuts through the modular compartment bulkhead assembly 200 at a location where the plane intersects with the second external body segment 240, the external seal body 203, and the internal seal body 221. Because FIG. 3F is a cross-section view, longitudinal axis 101 is defined as perpendicular to the plane B-B and is therefore represented as a dot. As such, FIG. 3F shows that, when assembled, a plane can be defined where the internal seal body 221 is concentric with the external seal body 203, which is also concentric with the second external body segment 240. Accordingly, the second end portion 241 of the second external body segment 240 may overlap the external seal body 203 of the first external body segment 201 and the external seal body 203 of the of the first external body segment 201 may overlap the internal seal body 221 of the bulkhead 220 at the plane B-B, which is a plane perpendicular to the longitudinal axis 101 and intersects with the second end portion 241, the external seal body 203, and the internal seal body 221.

Figure 4A:
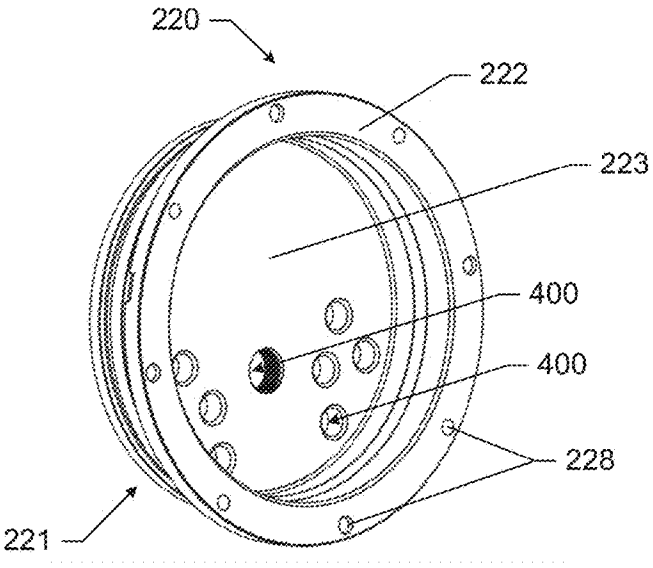
FIG. 4A illustrates a perspective front view of a bulkhead according to some example embodiments.
Figure 4B:
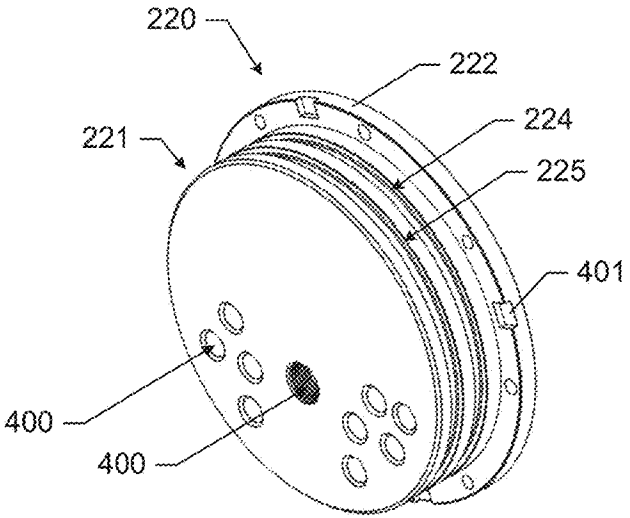
FIG. 4B illustrates a perspective rear view of a bulkhead according to some example embodiments.
Figure 4C:
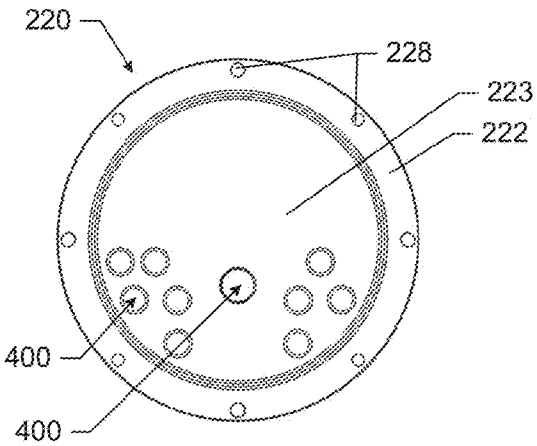
FIG. 4C illustrates a front view of a bulkhead according to some example embodiments.
Figure 4E:
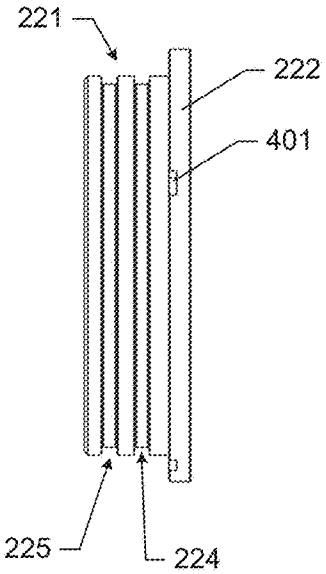
FIG. 4E illustrates a side view of a bulkhead according to some example embodiments.
Figure 4D:
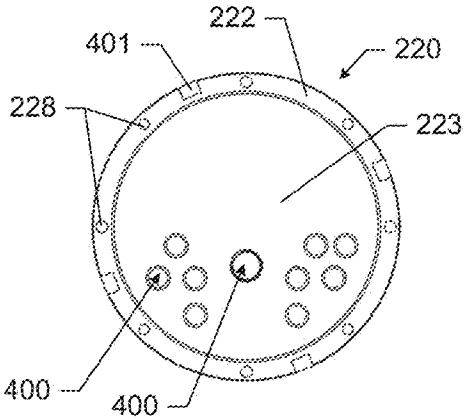
FIG. 4D illustrates a rear view of a bulkhead according to some example embodiments.

Having described example assembly processes and configurations of the modular compartment bulkhead assembly 200, FIGS. 4A to 4E will now be described which illustrate detailed views of the example bulkhead 220. However, the example embodiment of the bulkhead 220 shown in FIGS. 4A to 4E is a variation that includes modular compartment interface holes 400 as further described below. In this regard, FIG. 4A shows a perspective front view of the bulkhead 220, FIG. 4B shows a perspective rear view of the bulkhead 220, FIG. 4C shows a front view of the bulkhead 220, FIG. 4D shows a rear view of the bulkhead 220, and FIG. 4E shows a side view of the bulkhead 220.

Accordingly, as better shown in FIGS. 4A to 4E, the internal seal body 221 of the bulkhead 220 may extend from the flange 222 and may have an outer diameter is that is less than the outer diameter of the flange 222. The internal seal body 221 may also have a width that facilitates placement of the first internal seal groove 225 and the second internal seal groove 225 spaced apart on the outer surface of the internal seal body 221. Further, according to some example embodiments, the bulkhead wall 223 may extend across one end of the internal seal body 221 that is opposite the end that is coupled to the flange 222. In this regard, according to some example embodiments, the bulkhead wall 223 may be a base of a cavity formed in the internal seal body 221.

As mentioned above, the bulkhead wall 223 of the bulkhead 220 may include one or more modular compartment interface holes 400. The modular compartment interface holes 400 may be through holes in the bulkhead wall 223 that permit cabling, hoses, or other connection means to extend between modular compartments through the bulkhead 220. To maintain the waterproof integrity of the bulkhead 220 as a sealed barrier between the modular compartments, a filler substance may be applied around the connection means passing through a modular compartment interface hole 400 that fills the remainder of the modular compartment interface hole 400 and forms a sealed surface for the bulkhead wall 223. For example, if the connection means is a power cable, the power cable may be fed through the modular compartment interface hole 400 and an epoxy or other filler substance may be applied in the modular compartment interface hole 400 to seal the hole 400 with the power cable passing through the now-filled hole 400. As such, because, according to some example embodiments, the interface with the external seal body 203 is not a threaded interface requiring rotation of the bulkhead 220 to form the internal seal, such pass-through connection means may be utilized without the risk of twisting the connection means when installing the bulkhead 220 into the external seal body 203. According to some example embodiments, the modular compartment interface holes 400 may be threaded to facilitate coupling to a threaded connection means.

The flange 222, in addition to including the plurality of holes 228 for securing the bulkhead 220 to the external seal body 203, may also comprise one or more pry notches 401. The pry notches 401 may be cutouts in a rear face of the flange 222. When the bulkhead 220 is coupled to the external seal body 203, the pry notches 401 may be disposed adjacent to the bulkhead seating surface 205. As such, with the fasteners 252 removed from the holes 228, the pry notches 401 may be used to receive a prying device (e.g., a flat-blade screwdriver) that can be used to pry the bulkhead 220 away from the external seal body 203 to separate the bulkhead 220 from the external seal body 203.

Figure 5A:
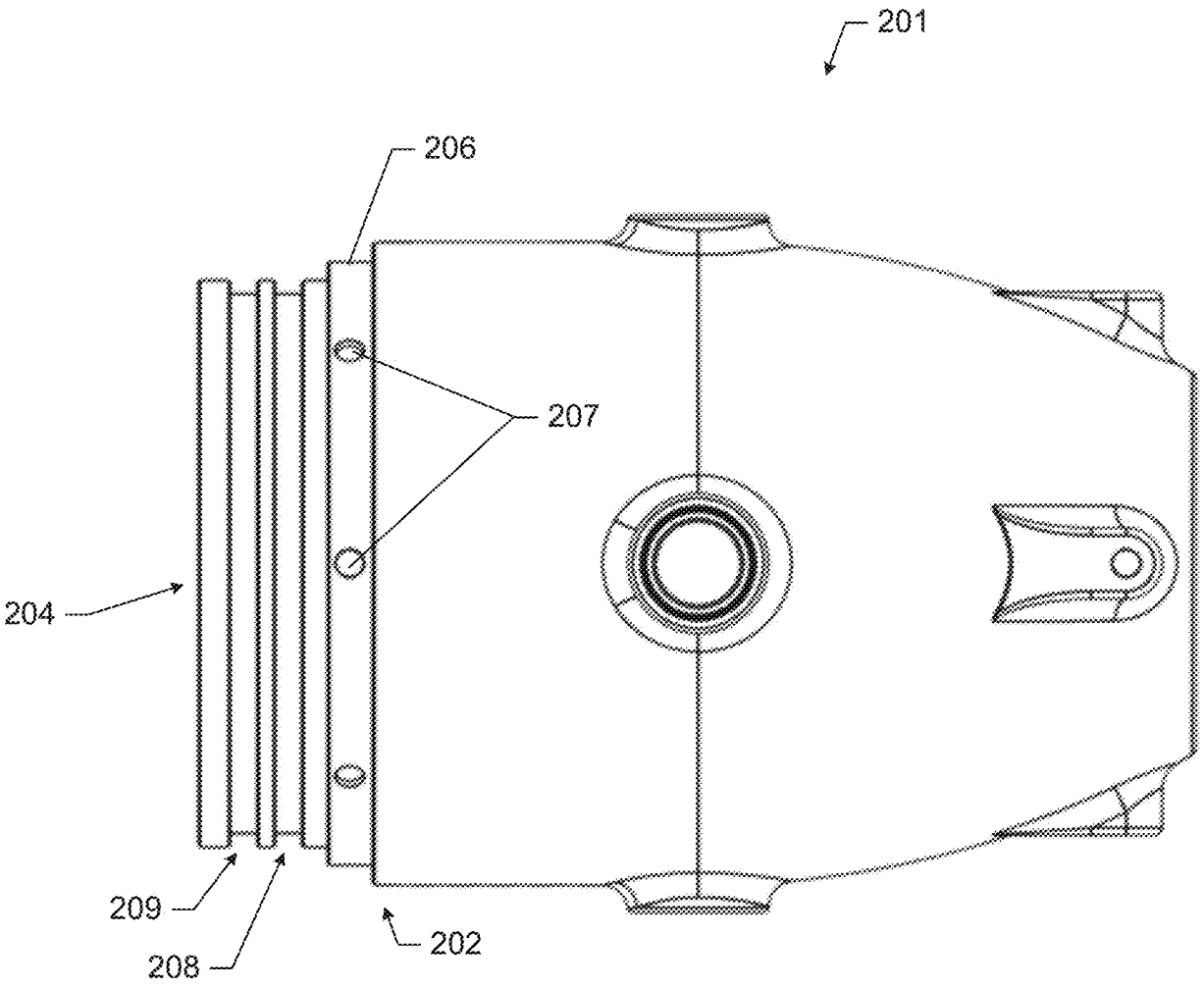
FIG. 5A illustrates a side view of a first external body segment and a first end according to some example embodiments.
Figure 5B:
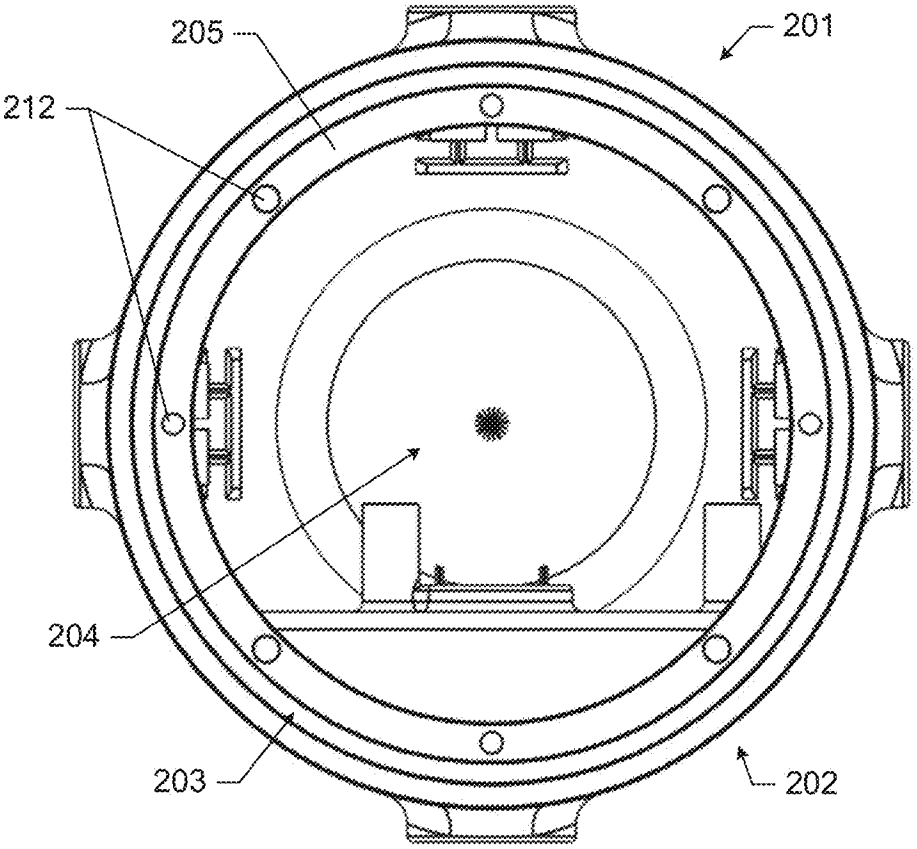
FIG. 5B illustrates a front view of a first external body segment and a first end portion according to some example embodiments.

FIGS. 5A and 5B will now be described which illustrate detailed views of first end portion 202 of the first external body segment 201, according to some example embodiments. In this regard, FIG. 5A shows a side view of the first external body segment 201 and the first end portion 202, and FIG. 5B shows a front view of the first external body segment 201 and the first end portion 202.

In this regard, referring to FIG. 5A, it can be seen that the first seating surface 206, comprising the holes 207, is recessed (i.e., has a smaller outer diameter) relative to the external surface of the first external body segment 201. Additionally, it can be seen that the outer diameter of the external seal body 203 is recessed (i.e., has a smaller outer diameter) relative to the outer diameter of the first seating surface 206. This difference in outer diameters between the first seating surface 206 and the external seal body 203 forms a ledge that corresponds to the internally recessed second seating surface 243 of the second external body segment 240 as described above. Additionally, the external seal body 203 may have a width that facilitates placement of the first external seal groove 208 and the second external seal groove 209 spaced apart on the outer surface of the external seal body 203.

Referring to FIG. 5B, the first external body segment 201 is again shown, according to some example embodiments, with details of the internal channel 204 and the bulkhead seating surface 205. In this regard, the external seal body 203 comprises an inner diameter and an outer diameter and, as a result, a front surface in the form of the bulkhead seating surface 205 may be defined. As such, the bulkhead seating surface 205 extends radially from a center point (i.e., the longitudinal axis 101) and includes holes 212 around the bulkhead seating surface 205. In addition to receiving the internal seal body 221 of the bulkhead 220, the internal channel 204 also defines a space to house operating components of a submersible vehicle.

Figure 6:
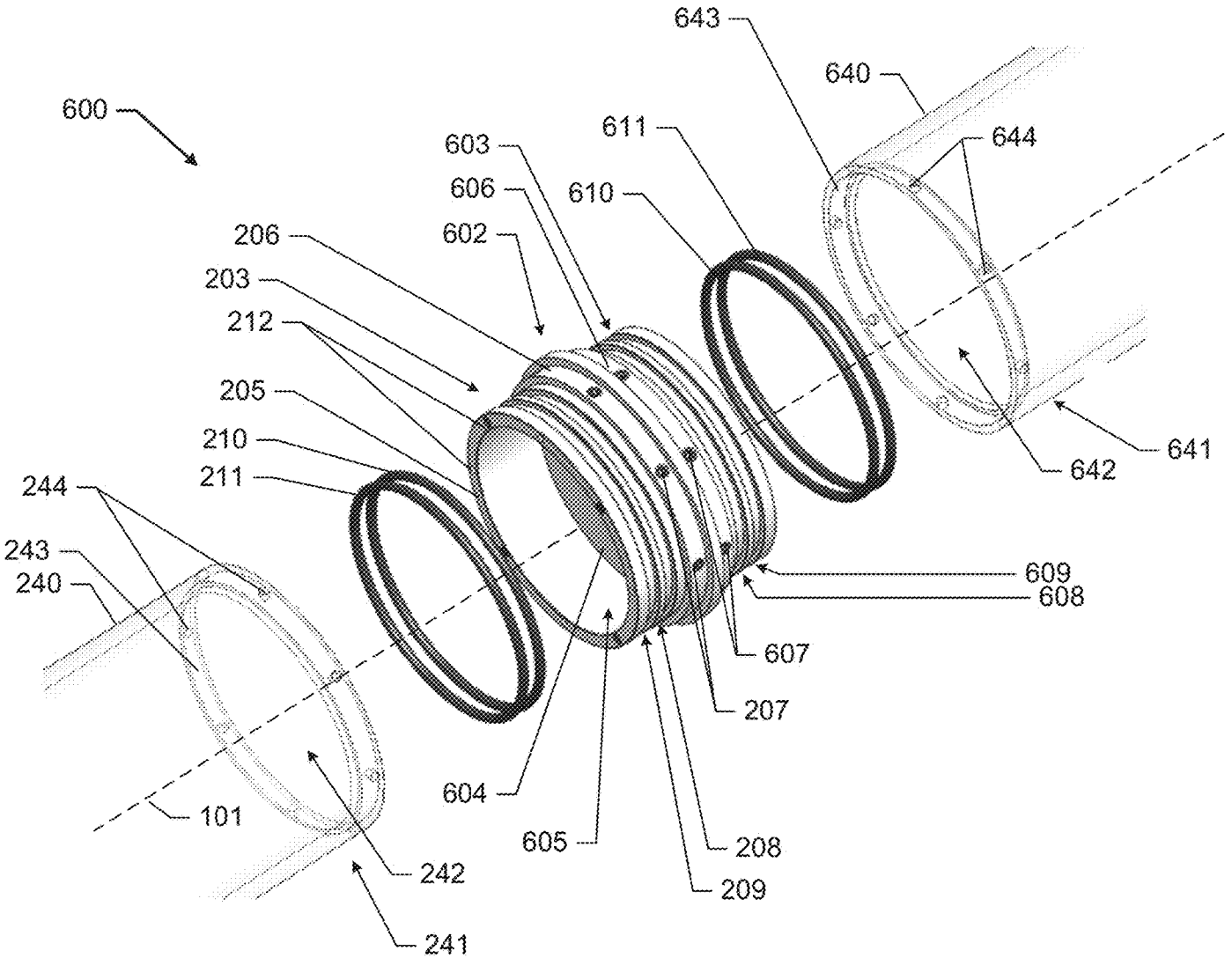
FIG. 6 illustrates an exploded view of another example modular compartment bulkhead assembly according to some example embodiments.

Now referring to FIG. 6, an exploded view of an alternative embodiment of a modular compartment bulkhead assembly 600 is shown. The modular compartment bulkhead assembly 600 comprises a bulkhead coupler 602 that includes aspects of the modular compartment bulkhead assembly 200 described above. In this regard, bulkhead coupler 602 may comprise the external seal body 203 (referred to in this example embodiment as the first external seal body 203) and a second external seal body 603. The first external seal body 203 and the second external seal body 603 may be coupled or integrated into a single unit that may be used as a connector and a seal between a first external body segment 640 and the second external body segment 240. The second external seal body 603 may be same or similar to the first external seal body 203 with the exception that the second external seal body 603 is oriented in an opposite direction along the longitudinal axis 101. In this regard, the first external seal body 203 may be oriented to engage with the second external body segment 240 on a first side of the bulkhead coupler 602 on the longitudinal axis 101, and the second external seal body 603 may be oriented to engage with the first external body segment 640 on a second, opposite, side of the bulkhead coupler 602 along the longitudinal axis 101.

According to some example embodiments, the bulkhead 220 described above, may be inserted into an internal channel 605 which may be shared between the first external seal body 203 and the second external seal body 603. As such, the bulkhead 220 may be secured to, for example, the first external seal body 203 in the same manner as described above. However, according to some example embodiments, rather than the bulkhead 220, the bulkhead of the bulkhead coupler 602 may comprise a bulkhead wall 604 that is disposed within the internal channel 605. In this regard, the bulkhead wall 604 may be an integrated component of the bulkhead coupler 602, according to some example embodiments.

As described above, the first external seal body 203, with the first external seal ring 210 and possibly the second external seal ring 211, may be piston sealed into the internal channel 242 of the second external body segment 240 and secured to the second external body segment 240. Similarly, the second external seal body 603, with a third external seal ring 610 and possibly the fourth external seal ring 611, may be piston sealed into the internal channel 642 of the first external body segment 640 and secured to the first external body segment 640 in the same manner.

The first end portion 641 of the first external body segment 640 may comprise a seating surface 643. The seating surface 643 may be disposed within the internal channel 642 of the first external body segment 640 on an inner wall of the internal channel 642. According to some example embodiments, the seating surface 643 may be recessed relative to the inner wall of the internal channel 642 such that the inner diameter of the seating surface 643 is greater than an inner diameter of the inner wall of the first external body segment 640. Additionally, the seating surface 643 may extend axially relative to the longitudinal axis 101. Further, the seating surface 643 may comprise a plurality of holes 644 disposed around the annular surface of the seating surface 643. The holes 644 may have a depth that extends in a radial direction relative to the longitudinal axis 101 and may be configured to receive respective fasteners.

The second external seal body 603 may be cylindrically shaped and extend from a seating surface 606 of the bulkhead coupler 602 in an axial direction relative to the longitudinal axis 101. Additionally, an outer surface of the external seal body 603 may be recessed relative to the seating surface 606. The outer surface of the second external seal body 603 may include a third external seal groove 608 and a fourth external seal groove 609. The third external seal groove 608 may be configured to receive a third external seal ring 610, and the fourth external seal groove 609 may be configured to receive a fourth external seal ring 611. The third external seal ring 610 and the fourth external seal ring 611 may be formed of an elastic material (e.g., rubber) such that the third external seal ring 610 and the fourth external seal ring 611 may be compressible to form a seal when compressed between the respective grooves 608 and 609 and inner wall of the internal channel 642.

The second external seal body 603 may be inserted into the internal channel 642 of the first external body segment 640 to form a second external seal and couple the first external body segment 640 to the first external body segment 240 in a waterproof fashion. The outer diameter of the external seal body 603 may be slightly less than the diameter of the inner wall of the internal channel 642 to permit the external seal body 603 to be inserted into the internal channel 642 of the first external body segment 640. The third external seal ring 610 and the fourth external seal ring 611 may extend radially relative to longitudinal axis 101 beyond the outer diameter of the external seal body 603. As such, when the external seal body 603 is inserted into the internal channel 642, the third external seal ring 610 and the fourth external seal ring 611 may engage with the inner wall of the internal channel 642 and be compressed between the respective external seal grooves 608 and 609 and the inner wall of the internal channel 642. The compression force on the third external seal ring 610 and the fourth external seal ring 611 may form an external seal in the form of a piston seal between the external underwater environment and the internal channel 642 of the first external body segment 640. Further, according to some example embodiments, the two seal rings 610 and 611 may be included to form a dual-external seal to create redundancy and ensure a waterproof seal. However, according to some example embodiments, a single seal ring may be used.

Engagement between the seating surface 606 and the seating surface 643 may secure the first external body segment 640 to the second external body segment 240. In this regard, the first external seal body 203 may be inserted into the internal channel 242 until a rim of second external body segment 240 engages with a rim of the bulkhead coupler 602 after passing over the seating surface 206 and further insertion is stopped. Similarly, the second external seal body 603 may be inserted into the internal channel 642 until a rim of first external body segment 640 engages with a rim of the bulkhead coupler 602 after passing over the seating surface 606 and further insertion is stopped. In this regard, according to some example embodiments, the first external seal body 203 may be inserted into the internal channel 242 until a radially extending edge of the seating surface 206 abuts a radially recessed edge of the second seating surface 243 and further insertion is stopped. Similarly, according to some example embodiments, the second external seal body 603 may be inserted into the internal channel 642 until a radially extending edge of the seating surface 606 abuts a radially recessed edge of the seating surface 643 and further insertion is stopped.

Similar to the description above regarding the securing of the external seal body 203, to secure the first external body segment 640 to the bulkhead coupler 602, the external seal body 603 may be inserted into the internal channel 642 such that the holes 607 in the seating surface 606 align with respective holes 644 in seating surface 643. According to some example embodiments, at least the holes 607 may be threaded. Fasteners, extending in a radial direction (similar to fasteners 251 of FIG. 3E), may be inserted into and through the holes 644 and into the holes 607 to secure the first seating surface 606 to the second seating surface 643 and the first external body segment 640. Additionally, according to some example embodiments, the outer diameter of the external surface of the first external body segment 640 may be the same as the outer diameter of the external surface of the second external body segment 240.

As such, with respect to the example embodiment of modular compartment bulkhead assembly 600, the assembly 600 may comprise a first external body segment 640 comprising a first end portion 641. The first end portion 641 may be coupled to a first external seal body 203. The first external seal body 203 may comprise a first internal channel 605. The modular compartment bulkhead assembly 600 may further comprise a bulkhead (e.g., bulkhead coupler 602) comprising a bulkhead wall 604 disposed within the first internal channel 605 of the first external seal body 203. According to some example embodiments, the modular compartment bulkhead assembly 600 may further comprise a second external body segment 240 comprising a second end portion 241. The second end portion 241 may comprise a second internal channel 242. The first external seal body 203 may being configured to be inserted into the second internal channel 242 to form an external seal between the first external seal body 203 and the second external body segment 240.

According to some example embodiments, the modular compartment bulkhead assembly 600 may include the first external body segment 640 comprising a third internal channel 642. Additionally, the modular compartment bulkhead assembly 600 may comprise a second external seal body 603. The second external seal body 603 may extend from and be integrated with the first external seal body 203 such that the first internal channel 605 extends within the first external seal body 203 and the second external seal body 603. The second external seal body 603 may be configured to be inserted into the third internal channel 642 to form a second external seal between the second external seal body 240 and the first external body segment 640.

Based on the foregoing and in view of the assembly operations described above, example methods for assembling a modular compartment bulkhead assembly of a submersible vehicle are provided. In this regard, according to some example embodiments, an example method is provided as illustrated by the flow chart of FIG. 7.

The example method may comprise, at 700, inserting an internal seal body of a bulkhead into a first internal channel of an external seal body of an end portion of a first external body segment to piston seal the bulkhead to the first external body segment via a first internal seal ring (and, in some example embodiments, a second internal seal ring) disposed between the internal seal body and the first internal channel. Additionally, the example method may comprise, at 710, securing a flange of the bulkhead to a bulkhead seating surface disposed on a rim of the external seal body. In this regard, the internal seal body of the bulkhead may extend from the flange. Additionally, according to some example embodiments, the example method may comprise, at 720, inserting the external seal body into a second internal channel in a second end portion of a second external body segment to piston seal the first external body segment to the second external body segment via a first external seal ring, (and, in some example embodiments, a second external seal ring) disposed between the external seal body and the second internal channel. Further, the example method may also comprise, at 730, securing a first seating surface of the first external body segment to a second seating surface of the second external body segment. In this regard, the external seal body may extend from the first seating surface.

Figure 7:
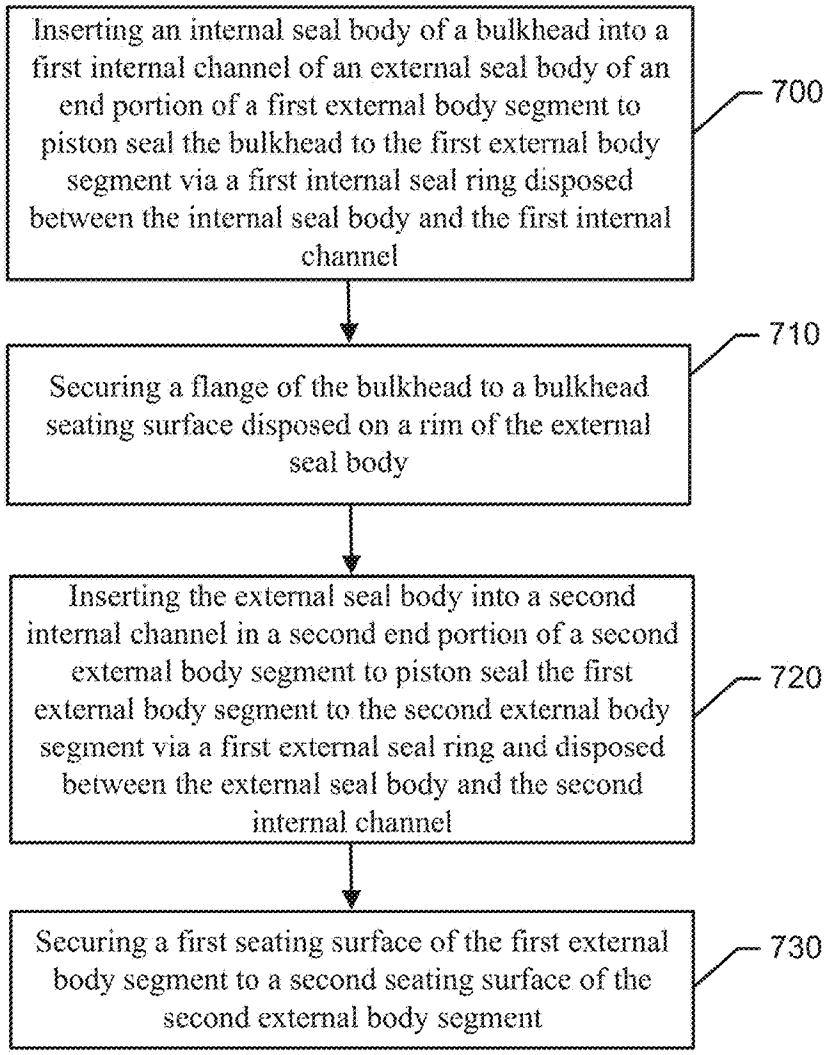
FIG. 7 illustrates a flowchart of an example method for assembling a modular compartment bulkhead assembly according to some example embodiments.

The example method of FIG. 7 may also be modified in view of the description of the assembly process described above with respect to FIGS. 3A to 3C. In this regard, for example, the example method may include such additional elements as securing the flange to the bulkhead seating surface via axially extending fasteners and securing the first seating surface to the second seating surface via radially extending fasteners.

In some embodiments of the example methods described above, additional optional operations may be included or the operations described above may be modified or augmented. Each of the additional operations, modification or augmentations may be practiced in combination with the operations above and/or in combination with each other. Thus, some, all or none of the additional operations, modification or augmentations may be utilized in some embodiments.

Additionally, according to some example embodiments, a submersible vehicle comprising a plurality of modular compartments is provided. The submersible vehicle may comprise a first compartment and a second compartment. At least one of the plurality of modular compartments may house a rechargeable battery and another of the modular compartments may house a propulsion system. The submersible vehicle may also comprise a modular compartment bulkhead assembly that forms an interface between the first modular compartment and the second modular compartment.

In this regard, the modular compartment bulkhead assembly may comprise a first external body segment comprising a first end portion. The first end portion may comprise and an external seal body and the external seal body may comprise a first internal channel. The modular compartment bulkhead assembly may also comprise a bulkhead comprising an internal seal body. The internal seal body may be configured to be inserted into the first internal channel of the external seal body to form an internal seal between the bulkhead and the first external body segment. The modular compartment bulkhead assembly may also comprise a second external body segment comprising a second end portion. The second end portion may comprise a second internal channel. The external seal body may be configured to be inserted into the second internal channel to form an external seal between the external seal body and the second external body segment.

According to some example embodiments, the first end portion of the first external body segment may further comprise a first seating surface and a bulkhead seating surface. In this regard, the external seal body may extend from the first seating surface and the bulkhead seating surface may be disposed on a rim of the external seal body. Additionally, the second end portion of the second external body segment may further comprise a second seating surface, and, the bulkhead may comprise a flange. The internal seal body may extend from the flange. The first seating surface may be configured to be secured to the second seating surface to secure the first external body segment to the second external body segment, and the flange may be configured to be secured to the bulkhead seating surface to secure the bulkhead to the first external body segment.

Additionally or alternatively, according to some example embodiments, the first external body segment, the second external body segment and the bulkhead may be positioned along a longitudinal axis. The first seating surface and the second seating surface may extend axially relative to the longitudinal axis, and the flange and the bulkhead seating surface may extend radially relative to the longitudinal axis. Additionally or alternatively, according to some example embodiments, the first seating surface may be secured to the second seating surface by a plurality of first fasteners. In this regard, each of the first fasteners may extend into the first seating surface and through the second seating surface in a radial direction relative to the longitudinal axis. The flange may be secured to the bulkhead seating surface by a plurality of second fasteners. In this regard, each of the second fasteners may extend through the flange and into the bulkhead seating surface in an axial direction relative to the longitudinal axis. Additionally or alternatively, according to some example embodiments, the second seating surface may be disposed within a recess in an inner surface of the second end portion, and the first seating surface may be recessed relative to an external surface of the first external body segment.

Additionally or alternatively, according to some example embodiments, an outer diameter of the external surface of the first external body segment may be equal to an outer diameter of an external surface of the second external body segment. Additionally or alternatively, according to some example embodiments, the external seal body may comprise a first external seal groove and a second external seal groove. A first external seal ring may be disposed in the first external seal groove and a second external seal ring may be disposed in the second external seal groove. The first external seal ring and the second external seal ring may piston seal against an inner wall of the second internal channel. Additionally or alternatively, according to some example embodiments, the internal seal body may comprise a first internal seal groove and a second internal seal groove, and a first internal seal ring may be disposed in the first internal seal groove and a second internal seal ring may be disposed in the second internal seal groove. The first internal seal ring and the second internal seal ring may piston seal against an inner wall of the second internal channel. Additionally or alternatively, the first external body segment, the second external body segment, and the bulkhead are positioned along a longitudinal axis, and the second end portion of the second external body segment may overlap the external seal body of the first external body segment and the external seal body of the of the first external body segment may overlap the internal seal body of the bulkhead such that a plane perpendicular to the longitudinal axis is defined that intersects with the second end portion, the external seal body, and the internal seal body.

The embodiments presented herein are provided as examples and therefore the disclosure is not to be limited to the specific embodiments disclosed. Modifications and other embodiments are intended to be included within the scope of the appended claims. Moreover, although the foregoing descriptions and the associated drawings describe example embodiments in the context of certain example combinations of elements and/or functions, different combinations of elements and/or functions may be used to form alternative embodiments. In this regard, for example, different combinations of elements and/or functions other than those explicitly described above are also contemplated. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments.

That which is claimed:

1. A modular compartment bulkhead assembly of a submersible vehicle, the modular compartment bulkhead assembly comprising:

a first external body segment comprising a first end portion, the first end portion coupled to an external seal body, the external seal body comprising a first internal channel;

a bulkhead comprising an internal seal body, the internal seal body being configured to be inserted into the first internal channel of the external seal body to form an internal seal between the bulkhead and the first external body segment; and a second external body segment comprising a second end portion, the second end portion comprising a second internal channel, the external seal body being configured to be inserted into the second internal channel to form an external seal between the external seal body and the second external body segment.

2. The modular compartment bulkhead assembly of claim 1, wherein the first end portion of the first external body segment further comprises a first seating surface and a bulkhead seating surface, the external seal body extending from the first seating surface and the bulkhead seating surface being disposed on a rim of the external seal body;

wherein the second end portion of the second external body segment further comprises a second seating surface;

wherein the bulkhead comprises a flange, the internal seal body extending from the flange; and wherein the first seating surface is configured to be secured to the second seating surface to secure the first external body segment to the second external body segment; and wherein the flange is configured to be secured to the bulkhead seating surface to secure the bulkhead to the first external body segment.

3. The modular compartment bulkhead assembly of claim 2, wherein the first external body segment, the second external body segment and the bulkhead are positioned along a longitudinal axis;

wherein the first seating surface and the second seating surface extend axially relative to the longitudinal axis; and wherein the flange and the bulkhead seating surface extend radially relative to the longitudinal axis.

4. The modular compartment bulkhead assembly of claim 3 wherein the first seating surface is secured to the second seating surface by a plurality of first fasteners, each of the first fasteners extending through the first seating surface and the second seating surface in a radial direction relative to the longitudinal axis; and wherein the flange is secured to the bulkhead seating surface by a plurality of second fasteners, each of the second fasteners extending through the flange and the bulkhead seating surface in an axial direction relative to the longitudinal axis.

5. The modular compartment bulkhead assembly of claim 2, wherein the second seating surface is disposed within a recess in an inner surface of the second end portion; and wherein the first seating surface is recessed relative to an external surface of the first external body segment.

6. The modular compartment bulkhead assembly of claim 1, wherein the modular compartment bulkhead assembly is disposed between a first modular compartment of the submersible vehicle and a second modular compartment of the submersible vehicle.

7. The modular compartment bulkhead assembly of claim 1, wherein the external seal body comprises a first external seal groove;

wherein a first external seal ring is disposed in the first external seal groove; and wherein a first external seal ring piston seals against an inner wall of the second internal channel.

8. The modular compartment bulkhead assembly of claim 7, wherein the internal seal body comprises a first internal seal groove;

wherein a first internal seal ring is disposed in the first internal seal groove; and wherein a first internal seal ring piston seals against an inner wall of the second internal channel.

9. The modular compartment bulkhead assembly of claim 1, wherein the first external body segment, the second external body segment, and the bulkhead are positioned along a longitudinal axis; and wherein the second end portion of the second external body segment overlaps the external seal body of the first external body segment and the external seal body of the of the first external body segment overlaps the internal seal body of the bulkhead such that a plane perpendicular to the longitudinal axis is defined that intersects with the second end portion, the external seal body, and the internal seal body.

10. A modular compartment bulkhead assembly of a submersible vehicle comprising:

a first external body segment comprising a first end portion, the first end portion coupled to an external seal body, the external seal body comprising a first internal channel;

a bulkhead comprising a bulkhead wall disposed within the first internal channel of the external seal body; and a second external body segment comprising a second end portion, the second end portion comprising a second internal channel, the external seal body being configured to be inserted into the second internal channel to form an external seal between the external seal body and the second external body segment.

11. The modular compartment bulkhead assembly of claim 10, wherein the external seal body is a first external seal body and the first external body segment comprises a third internal channel; and wherein the modular compartment bulkhead assembly comprises a second external seal body, the second external seal body extending from and being integrated with the first external seal body such that the first internal channel extends within the first external seal body and the second external seal body;

wherein the second external seal body is configured to be inserted into the third internal channel to form a second external seal between the second external seal body and the first external body segment.

12. The modular compartment bulkhead assembly of claim 11, wherein the bulkhead further comprises an internal seal body and the bulkhead wall is disposed within the internal seal body, the internal seal body being configured to be inserted into the first internal channel of the external seal body to form an internal seal between the bulkhead and the first external body segment.

13. The modular compartment bulkhead assembly of claim 12, wherein the first end portion of the first external body segment further comprises a first seating surface and a bulkhead seating surface, the external seal body extending from the first seating surface and the bulkhead seating surface being disposed on a rim of the external seal body;

wherein the second end portion of the second external body segment further comprises a second seating surface;

wherein the bulkhead comprises a flange, the internal seal body extending from the flange;

wherein the first seating surface is configured to be secured to the second seating surface to secure the first external body segment to the second external body segment; and wherein the flange is configured to be secured to the bulkhead seating surface to secure the bulkhead to the first external body segment.

14. The modular compartment bulkhead assembly of claim 13, wherein the first external body segment, the second external body segment and the bulkhead are positioned along a longitudinal axis;

wherein the first seating surface and the second seating surface extend axially relative to the longitudinal axis; and wherein the flange and the bulkhead seating surface extend radially relative to the longitudinal axis.

15. The modular compartment bulkhead assembly of claim 14, wherein the first seating surface is secured to the second seating surface by a plurality of first fasteners, each of the first fasteners extending through the first seating surface and the second seating surface in a radial direction relative to the longitudinal axis; and wherein the flange is secured to the bulkhead seating surface by a plurality of second fasteners, each of the second fasteners extending through the flange and the bulkhead seating surface in an axial direction relative to the longitudinal axis.

16. The modular compartment bulkhead assembly of claim 12, wherein the external seal body comprises a first external seal groove and a second external seal groove;

wherein a first external seal ring is disposed in the first external seal groove and a second external seal ring is disposed in the second external seal groove; and wherein the first external seal ring and a second external seal ring piston seal against an inner wall of the second internal channel.

17. The modular compartment bulkhead assembly of claim 16, wherein the internal seal body comprises a first internal seal groove and a second internal seal groove;

wherein a first internal seal ring is disposed in the first internal seal groove and a second internal seal ring is disposed in the second internal seal groove; and wherein the first internal seal ring and a second internal seal ring piston seal against an inner wall of the second internal channel.

18. The modular compartment bulkhead assembly of claim 12, wherein the first external body segment, the second external body segment, and the bulkhead are positioned along a longitudinal axis; and wherein the second end portion of the second external body segment overlaps the external seal body of the first external body segment and the external seal body of the of the first external body segment overlaps the internal seal body of the bulkhead such that a plane perpendicular to the longitudinal axis is defined that intersects with the second end portion, the external seal body, and the internal seal body.

19. A method for assembling a modular compartment bulkhead assembly of a submersible vehicle, the method comprising:

inserting an internal seal body of a bulkhead into a first internal channel of an external seal body of an end portion of a first external body segment to piston seal the bulkhead to the first external body segment via a first internal seal ring disposed between the internal seal body and the first internal channel; and inserting the external seal body into a second internal channel in a second end portion of a second external body segment to piston seal the first external body segment to the second external body segment via a first external seal ring disposed between the external seal body and the second internal channel.

20. The method of claim 19, further comprising:

securing a flange of the bulkhead to a bulkhead seating surface disposed on a rim of the external seal body, the internal seal body extending from the flange; and securing a first seating surface of the first external body segment to a second seating surface of the second external body segment, the external seal body extending from the first seating surface.

* * * * *